United States Patent [19]

Scheepers

[11] 4,421,440

[45] Dec. 20, 1983

[54] PROCESS AND APPARATUS FOR APPLYING PILE PLANKING

[75] Inventor: Joseph G. B. Scheepers, Maastricht, Netherlands

[73] Assignees: Maascom B.V., Maastricht; Laura Metaal B.V., Eygelshoven, both of Netherlands

[21] Appl. No.: 260,184

[22] Filed: May 6, 1981

[30] Foreign Application Priority Data

May 14, 1980 [NL] Netherlands ..... 8002788
Mar. 31, 1981 [EP] European Pat. Off. ..... 81200359.8

[51] Int. Cl.[3] ..... E02D 17/04

[52] U.S. Cl. ..... 405/282; 52/309.11; 52/799

[58] Field of Search ..... 405/282, 280, 272; 52/799, 800, 780, 797

[56] References Cited

U.S. PATENT DOCUMENTS

| | | | |
|---|---|---|---|
| 2,970,553 | 2/1961 | Allen | 52/800 X |
| 3,217,845 | 11/1965 | Reynolds | 52/799 X |
| 3,331,174 | 7/1967 | Wesch | 52/309.11 |
| 3,910,054 | 10/1975 | Krings | 405/282 |
| 3,950,952 | 4/1976 | Krings | 405/282 |
| 4,274,763 | 6/1981 | Krings | 405/282 |

FOREIGN PATENT DOCUMENTS

| | | | |
|---|---|---|---|
| 2364383 | 6/1975 | Fed. Rep. of Germany | 405/282 |
| 2835948 | 2/1980 | Fed. Rep. of Germany | 405/282 |
| 3015110 | 10/1981 | Fed. Rep. of Germany | 405/282 |

*Primary Examiner*—Nile C. Byers, Jr.
*Attorney, Agent, or Firm*—Majestic, Gallagher, Parsons & Siebert

[57] ABSTRACT

The invention relates to the lining of an excavation with pile planking elements (7,8) placed one above the other, which are displaceable in vertical guide means (5) with the use of barrel-like rollers movable in guiding profiles. The lower pile planking element (8) may be removed after displacement behind the upper pile planking element. For this purpose the vertical guide elements attached to the vertical guide means are arranged in such a way that they are backwards displaceable, for example by means of hingeable levers (24,25). The planking element consists of two parallel flat plates (30,31), which are connected by terminal profiles (32,33) between which spacer elements (40) are present in the form of hat-like prolonged parts.

13 Claims, 12 Drawing Figures

PROCESS AND APPARATUS FOR APPLYING PILE PLANKING

DESCRIPTION

1. Technical Field

The invention relates to a process for the lining of an excavation and the like by means of pile planking elements displaceable in vertical guides, wherein at least two pile planking elements are situated vertically one above the other.

2. Background Art

To prevent an excavation and the like from collapsing, one often makes use of a pile planking construction wherein a number of guiding means are placed opposite to each other which, if necessary, are kept spaced apart from each other by means of props. The guiding means themselves are provided with guiding elements between which pile planking elements are displaceable. For a small depth it is sufficient to insert only one pile planking element between each set of guide means but in case of greater depths it is preferred to divide the pile planking elements in elements placed one atop of each other. These pile planking elements are inserted from above so that when deepening the excavation the pile planking elements will correspondingly sink or be driven in. When the operations concerning such an excavation are completed, for example after laying a sewerage, the pile planking elements have to be removed.

In connection with the great pressure which may be exerted by the ground on the pile planking elements it is not easy to pull up both elements at a time. When the upper planking element is removed first it is possible that the upper part of the excavation will collapse resulting in the lower element being more difficult to remove.

It has already been suggested that deeper excavations can be carried out stepwise with each pile planking element having a separate guide means, wherein the lowest planking element, both when being inserted and removed, is replaceable behind the upper element. In order to obtain an effective width on the bottom level of the excavation more soil has to be removed at the upper part of the excavation. Further, the costs of such vertical guide means are greater than those associated with other prior art devices.

DISCLOSURE OF THE INVENTION

The invention contemplates a simple process for lining an excavation of the type discussed, as well as an apparatus for applying such a process and a planking element to be used therewith.

According to the invention it is proposed to each time eliminate the lowest of a number of pile planking elements by displacing the lowermost element of the wall to be supported backwards and subsequently removing it upwards behind the upper element, whereafter the upper pile planking element and afterwards also the guide means can be taken away.

An apparatus for applying this process comprising at least two guide means to be placed substantially vertical, between which a number of pile planking elements may continually be placed vertically in one face, one above the other. According to the invention the apparatus is constructed in such a way that the guiding elements at the vertical guide means for at least one lower planking element are movable in such a way that the lower pile planking element at least at the upper edge and at least over a distance equal to the thickness of the upper pile planking element can be displaced backwards.

One may use hingeable lever elements on which either one or a number of guide elements are arranged in such a way that when the pile planking lining is finished the lever is in operating position and is directed substantially squarely to the face of the pile planking elements. However, the lever is displaceable in upwards and backwards direction to release the lowest pile planking element when removing the pile planking lining.

In an advantageous embodiment use is made of one lever which, through a connecting rod with compression members, releases the lowest pile planking element when it is moved upwards and backwards.

In this way it suffices to use relatively simple guide means, it being only necessary that the guide means within reach of the lowermost pile planking elements are movable over a certain distance. In this way a minimum of ground displacement over the full height of the excavation will be sufficient for a certain working distance. Moreover the props may be as short as possible and consequently be made firm and economically advantageous.

In a further embodiment of the invention it has appeared that a particularly effective guidance between the guide means and the pile planking elements can be reached when use is made of this guidance for substantially barrel-shaped rollers, which are movable in guide profiles with V-shaped or truncated V-shaped guiding profiles. In such an embodiment, wherein for each pile planking element use is made of at least four rollers (one in each corner of the pile planking element) jamming is effectively prevented which might be otherwise caused if there was warping of the pile planking elements as they are driven in or removed. With such a construction, which is particularly applicable for use in the present invention, the pile planking elements may be placed and removed with a minimum of effort, while substantially no maintenance is required. It has further been found that a very light and stable pile planking element is obtained when this, as is known per se, is built up of two parallel flat elements, which along the four edges are provided with an end profile and wherein between the two flat plates spacer elements are provided formed by substantially hat-shaped parts. Preferably these hat-shaped elements are alternatively placed in horizontal lines, the elements in two neighboring lines being staggered in respect of each other.

BEST MODE OF CARRYING OUT THE INVENTION

Figure 1:
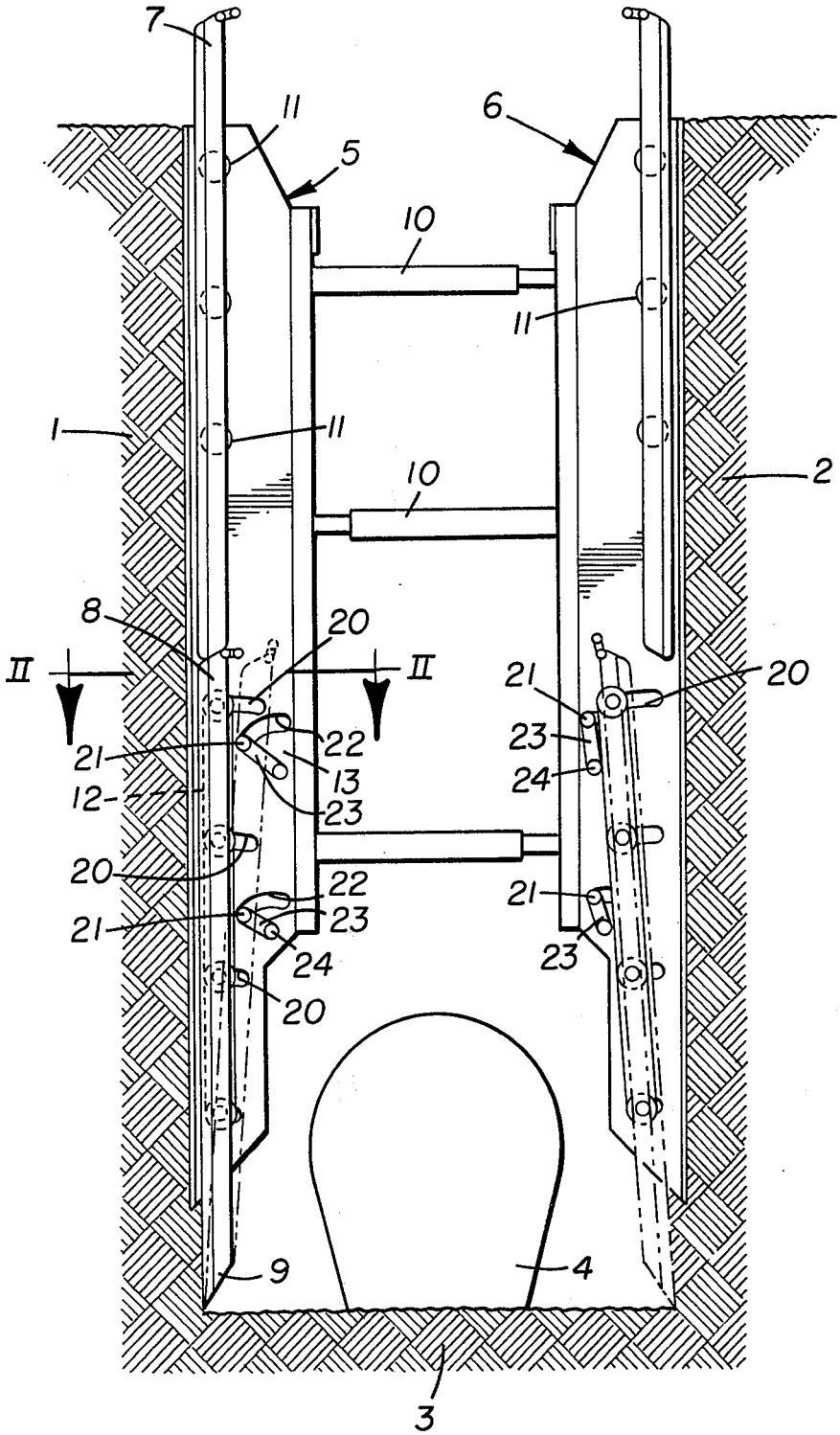
FIG. 1 shows schematically in side view, partially in section, an excavation provided with a pile planking construction according to the invention.

In FIG. 1 a pile planking element construction is shown schematically. This consists substantially of a rectangular excavation, of which the walls 1,2 are indicated as well as a bottom floor 3.

On this bottom, in the example, a sewage tube element 4 has been placed. The walls 1 and 2 of the excavation are supported by a pile planking construction according to the invention. This is built up out of a number of substantially vertically placed guide means 5,6, always between two parallel guides or means 5 alongside one wall, planking elements being provided.

Figure 2:
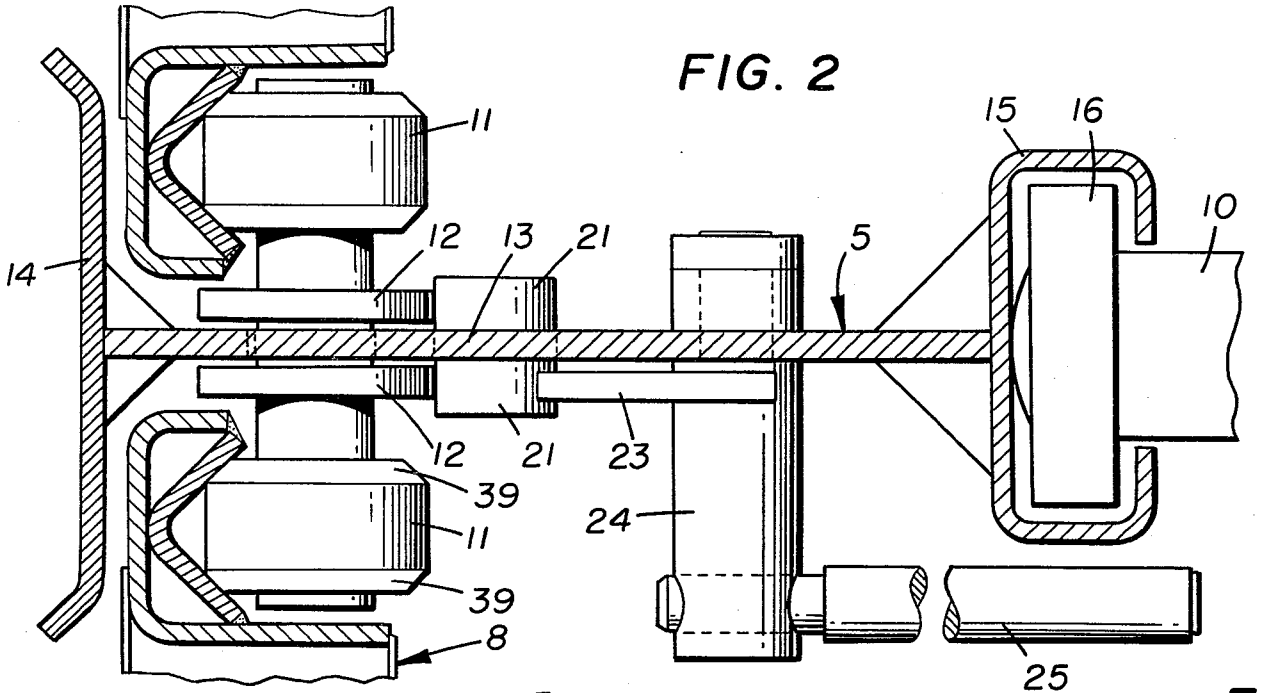
FIG. 2 shows on a larger scale in horizontal section a detail of FIG. 1 along lines II—II.
Figure 6:
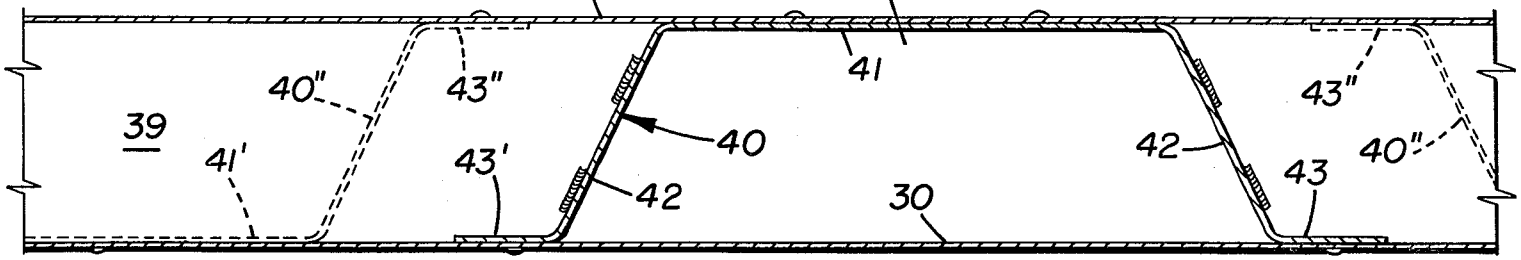
FIG. 6 shows on a larger scale in horizontal section a detail of the pile planking element of FIG. 3 according to line VI—VI.
Figures 3, 4, 5:
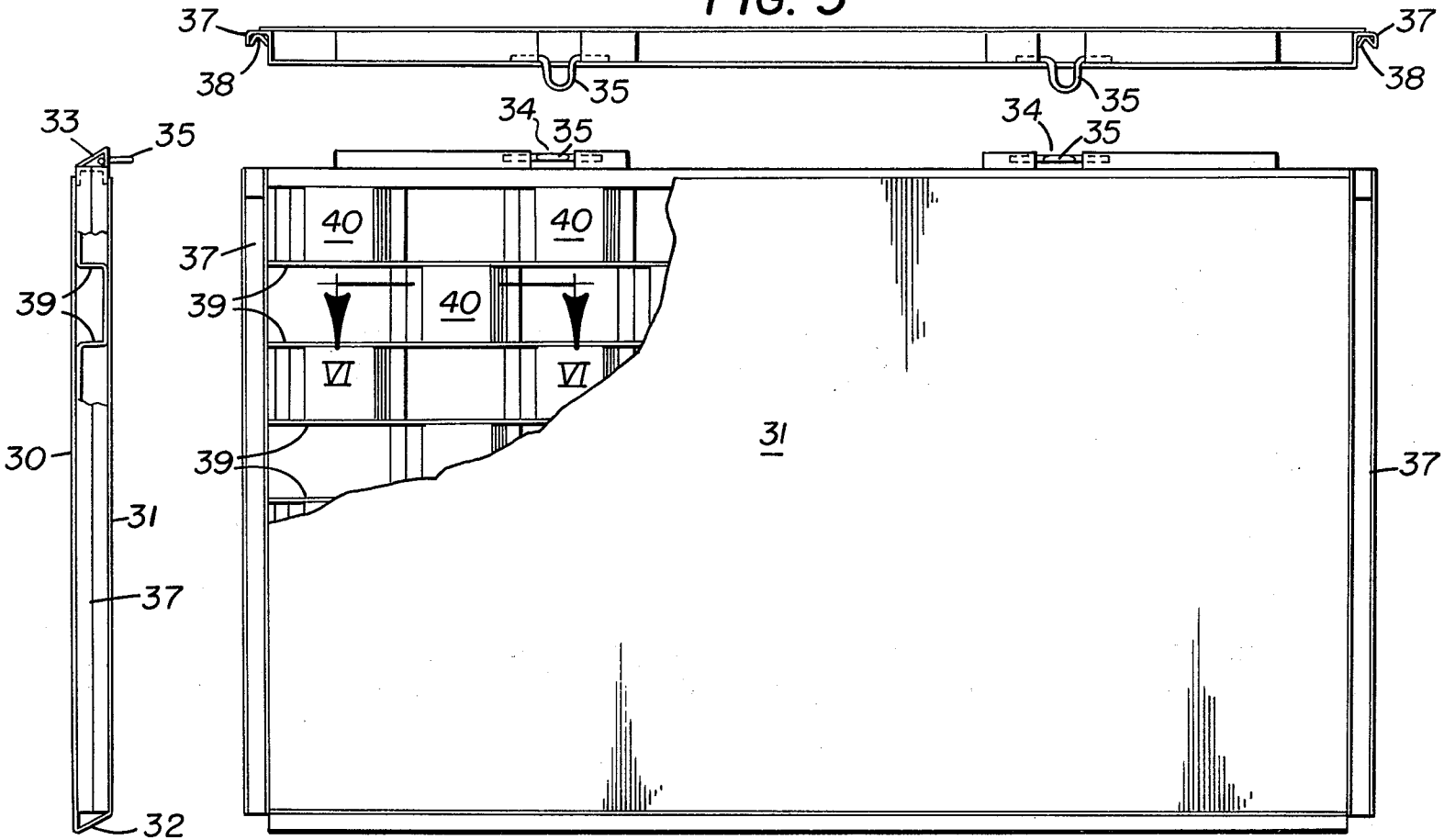
FIG. 3 is an upper plan view of a pile planking element according to the invention.
FIG. 4 shows in side elevation the pile planking element according to FIG. 3.
FIG. 5 is another side elevation of the pile planking element according to FIG. 3.

An upper pile planking element is indicated by 7 and a similar lower element by 8. Although the pile planking elements may in principle be made equal, it is preferred to construct the lower pile planking element with a sharp edge at 9, so that it can easily be driven into the ground, whereafter the ground between the pile planking elements can be excavated until the desired level of bottom 3 has been reached. The pair of oppositely placed guide means 5,6 are always spaced apart by means of props 10. This is in itself well known. The pile planking elements 7,8 may be moved downwards after the guide means 5,6 have been inserted along guiding elements, in the example rollers 11. The lower rollers meant for the lower pile planking elements 8 are not directly supported by bearings such as the upper rollers to guide means 5,6 but, as is shown more clearly in FIG. 2, are always supported by bearings on a supporting section 12. This supporting section is situated on either side of a body plate 13 of the guide means 5 (see FIG. 2).

This guide means is further provided with a front plate 14, which abuts against the wall of the excavation, while the body part 13 is at the other side provided with a substantially C-shaped guide means 15 for heads 16 of props 10. The supporting means 12 are arranged on either side of the body plate 13 and connected by pins, which extend through elongated openings 20 of the body, by which the supporting means 12 are movable in a horizontal direction.

A pair of compression elements 21 abut against the backside of the supporting means 12. These compression elements extend through slots 22, which have circular shape, in body 13. These compression elements are arranged at the end of each arm 23. This arm 23 is firmly connected to a hingeable arm 24, which is supported by a bearing in body plate 13. At the end of arm 24 a lever 25 is engageable to displace the compression members 21.

By moving the lever 25 the compression members may be displaced from the position in drawn lines to the position shown by the dash lines. In the position indicated by drawn lines the guiding supports 12 are orientated in such a way that all rollers 11 are always vertically on top of each other in guide means 5,6. In the position indicated by dash lines, the guiding supports 12 are retracted so far that the lower rollers withdraw from the wall 2,1, in which case also the pile planking elements 8, at least at the top part thereof, are displaced so far backwards that they can be pulled out upwards along the upper pile planking element 7.

It is observed that the upper part of the pile planking element 8 and the lower parts of the pile planking elements 7 are made correspondingly slanting in such a way that the lower pile planking elements can easily move backwards.

It is understood that instead of hingeable arms 23 with compression members 21, one may also use simply removable compression members, which are for instance made as wedges or keys for fixing the supporting parts 12 in the operative position.

Figure 7:
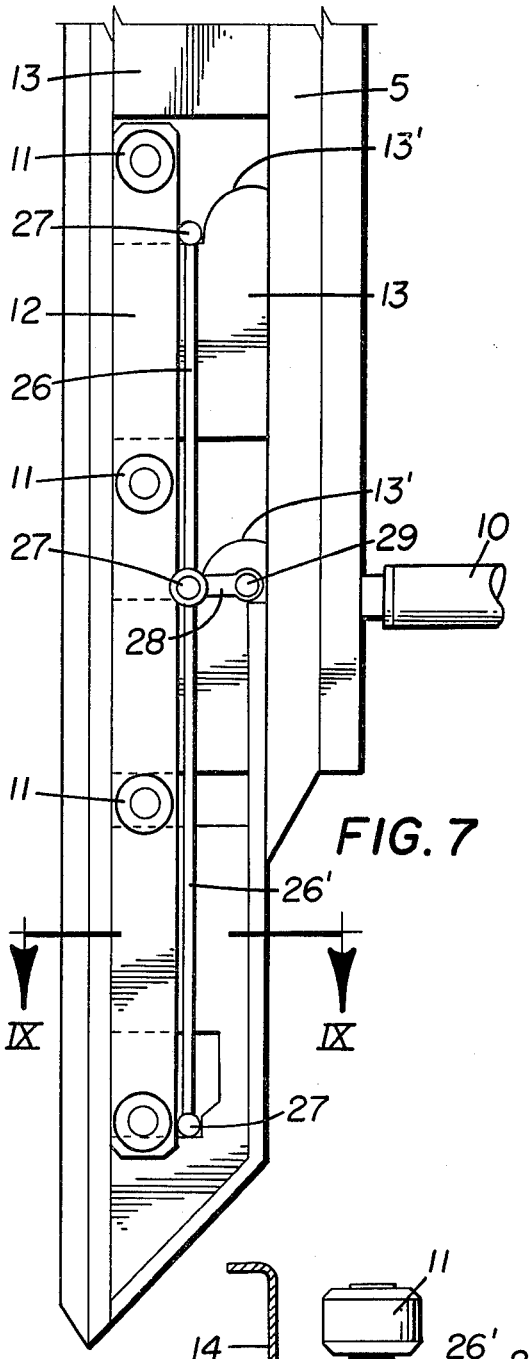
FIG. 7 schematically shows a side view of a pile planking element in operative position according to another embodiment of the invention.
Figure 8:
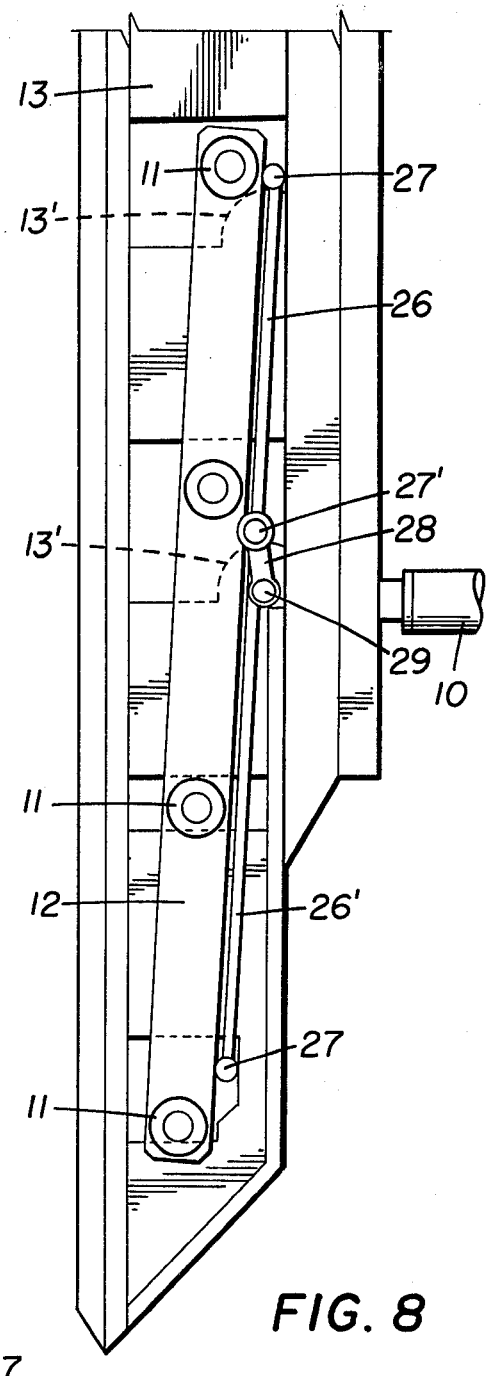
FIG. 8 shows the situation wherein the lower pile planking element according to FIG. 7 may be removed from the excavation.
Figure 9:
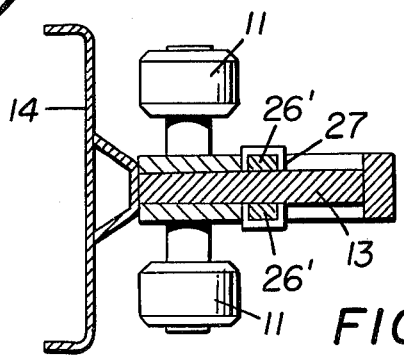
FIG. 9 shows a section of FIG. 7 along the line IX—IX.

In another advantageous embodiment as shown in FIGS. 7,8 and 9, a single lever construction is used to fix and release the pile planking element. In FIG. 7 the lower pile planking element is shown in operative position, which element is maintained in position by compression members or rollers 27, which are fixed to a connecting rod 26,26'. During movement of the lever system, as shown in FIG. 8, through hingeable arm 29, lever arm 28 and compression member 27', pivotably supported to the lever, the rollers 27' and 27 (which function as a compression member) move in a slit 13' in the body member 13, by means of which the compression member moves away from the supporting plate. The lower compression member needs only move slightly upwards to give the necessary space to the lower roller 11. As also appears from FIGS. 3–6, each pile planking element is built up of two flat plates, a front plate 30 and back plate 31. A profile 32 with a triangular cross section is present at the bottom edge and a correspondingly shaped profile 33 at the top part. As a consequence of the inclined course of the triangular profile 33 at the top part, a lower pile planking element may easily move backwards, provided the guide means will allow this. The upper profile part 33 does not extend over the full length of the pile planking element but is locally interrupted at 34. In this place a substantially U-shaped drawing eye 35 is arranged. This drawing eye is by means of legs pivotally connected in the triangular profile 33. By means of the drawing hook or eyes a pile planking element may be drawn away upwards. Laterally of the pile planking elements and also serving to finish both parallel plates 30 and 31, an end profile 37 is provided. In this end profile 37, a profile with an L-shaped section or angular section 38 is provided. These angular profiles 38 serve for the guidance of the pile planking elements and are therefore in contact with the rollers 11. The rollers 11 are not fully cylindrical but sloped at the corners 39 so that the shape of a barrel is obtained. By the cooperation of the rollers 11 with the angular profiles 38 an efficient guidance of the pile planking elements is obtained, in such a way that jamming of the pile planking elements in case of their being pulled upwards in an inclined way will be prevented. In this way jamming of the pile planking elements is in all circumstances avoided.

In another embodiment instead of a drawing eye locally, a hingeable plate provided with a slot is arranged, which when the wall has to be pulled out is turned in a vertical position, whereafter the wall may be removed by, for example, a chain with a hook, which engages in a slot.

Figure 10:
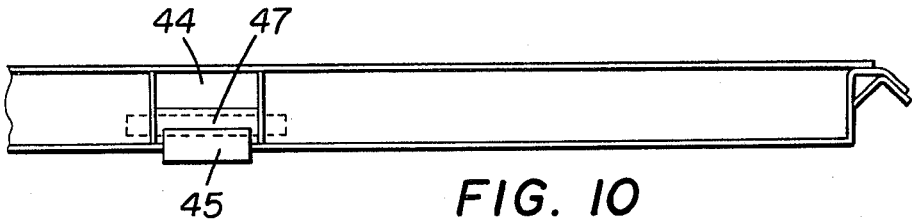
FIG. 10 shows a side view of a part of a pile planking element according to another embodiment of the invention.
Figure 11:
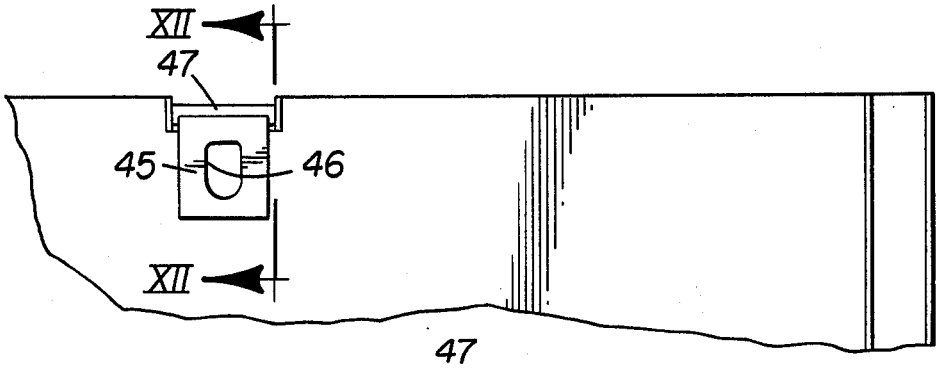
FIG. 11 shows in plan view a part of the pile planking element according to the embodiment of the invention of FIG. 10.
Figure 12:
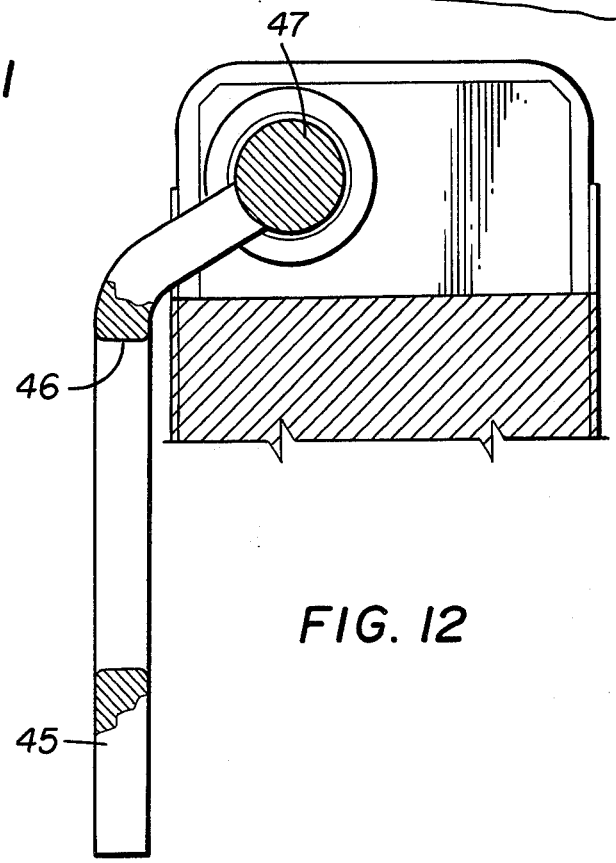
FIG. 12 shows another side view of the embodiment of FIG. 10.

On the site of the interruption 44 this plate in FIG. 10 is indicated with 45, while in FIG. 11 slot 46 and axis 47 are visible. In FIG. 12 is shown (on an enlarged scale, according to section XII—XII of FIG. 11) plate 45, which is pivotable around axis 47 in an upwards direction. Naturally more levers of this type may be present.

An efficient construction of the pile planking elements includes parallel plates 30,31 spaced apart by a hat-like cross section. These spacer elements (in FIG. 6) generally indicated by 40, comprise a body portion 41, inclined flanges 42 and edges 43, which are spaced apart from the body portion 41. In this construction, the hat-like spacer elements 40 are each in a series with the body portion 41 connected to the one plate 31. The spacer elements 40'' in an adjacent series are, however, connected to this plate 31 by means of the flanges 43''. Between each series there is always a horizontal baffle 39. The spacer elements are locally also welded to these baffles 39.

In the construction of a similar pile planking element one starts from one of the flat plates, onto which the edge profiles are arranged, and the baffles as well as the spacer elements welded. This welding can be accomplished partly by spot welding, and partly by $C0_2$ welding. Subsequently the other parallel running plate is arranged, which by means of unilateral spot welding is welded to the relative parts 41',43' of the spacer elements as well as to the edge profiles and baffles.

I claim:

1. A method for lining an excavation by means of a plurality of vertical guide means which are erected at certain distances alongside the excavation walls wherein, between each two adjacent guide means erected alongside the same wall, at least two superimposed pile planking elements one after and on top of the other are inserted in a common plane and guided by a common guide which forms part of the guide means, and wherein the elements can be removed by the steps of:

displacing the lower pile planking element in a direction away from the adjacent wall;

removing the lower pile planking element behind and along the respective upper pile planking element; and removing the upper pile planking element.

2. An apparatus for lining an excavation comprising:

at least two substantially vertical guide means erected alongside and spaced apart from one another on an excavation wall;

two pile planking elements, with one element placed substantially vertically on top of the other in a common plane, said two elements being inserted between two adjacent guide means;

a common guide for guiding the two planking elements; and a supporting means on which said common guide is mounted for supporting the lower pile planking element, wherein at least the upper portion of said supporting means being displaceably mounted onto the guide means so that the upper portion of the lower pile planking element is movable away from the excavation wall.

3. Apparatus according to claim 2 wherein the upper portion of the supporting means is so displaceably mounted onto the guide means that the upper edge of the lower pile planking element is movable away from the excavation wall over at least the thickness of the upper pile planking element.

4. Apparatus according to claim 2 wherein at least part of the supporting means includes hingeable levers.

5. Apparatus according to claim 2 wherein the supporting means includes a series of hingeable levers, which levers are substantially at right angles with the surface of the lower pile planking element when the pile planking element has been erected, which levers are hingeable in a direction upwards and away from the excavation wall for releasing the lower pile planking element upwards.

6. Apparatus according to claim 2 wherein the supporting means for each lower pile planking element at every guide means includes a supporting section, which supporting section in respect of the guide means can be moved away from the excavation wall.

7. Apparatus according to claim 6, wherein each supporting section is movable squarely on the surface of the pile planking elements by means of horizontal guiding elements, these supporting sections in operative position are held in place by compression elements, said elements being movable for releasing the supporting sections in order to remove the lower pile planking element.

8. Apparatus according to claim 7, wherein the compression elements are connected with each other by means of a connecting rod which is movable and which is able to displace the compression elements for releasing the supporting sections in order to remove the lower pile planking element.

9. Apparatus according to claim 2, wherein the guide means includes guiding parts formed by substantially barrel-shaped rollers movable in guiding profiles defined by the pile planking elements, which guiding profiles in cross section form a substantially V-shaped guiding rail.

10. Apparatus according to claim 9, wherein the V-shaped guiding rail is arranged laterally along the pile planking elements and the rollers are connected hingeably in respect to the rest of the guide means.

11. Apparatus according to claim 10, wherein at least some of the rollers are movable away from the excavation wall in respect to the rest of the guide means.

12. Apparatus according to claim 2 wherein each pile planking element comprises two substantially parallel flat plates, which along the four edges are connected end profiles and wherein between the flat plates spacer elements are present, characterized in that the spacer elements are formed by hat-shaped prolonged parts, each connected with the flat plates by means of welds.

13. Apparatus according to claim 12, wherein the hat-shaped spacer elements are arranged in horizontal series beside and below each other, and wherein the spacer elements are arranged in a staggered position from series to series in relation to each other.

* * * * *